United States Patent [19]

Murray

[11] 4,137,461

[45] Jan. 30, 1979

[54] PHOTOGRAPHIC IMAGE ENHANCEMENT BY PHOTOFISSION

[75] Inventor: Kenneth M. Murray, Falls Church, Va.

[73] Assignee: The United States of America as represented by the Secretary of the Navy, Washington, D.C.

[21] Appl. No.: 852,126

[22] Filed: Nov. 16, 1977

[51] Int. Cl.[2] ..... G03C 5/08; G03C 5/46; G03C 11/22

[52] U.S. Cl. ..... 250/526; 96/27 E; 156/643; 204/6

[58] Field of Search ..... 96/27 E, 27 F, 36; 250/492 R, 493, 474, 526, 303; 204/6; 156/643, 663

[56] References Cited

U.S. PATENT DOCUMENTS

| | | | |
|---|---|---|---|
| 3,852,134 | 12/1974 | Bean | 204/6 |
| 3,922,206 | 11/1975 | Thackray | 156/643 |

*Primary Examiner*—Alfred E. Smith
*Assistant Examiner*—T. N. Grigsby
*Attorney, Agent, or Firm*—R. S. Sciascia; Philip Schneider

[57] ABSTRACT

A method for producing a replica image with enhanced contrast from an original photographic image comprising toning the original photographic negative with a stable photofissionable isotope material, placing the toned negative in contact with a replication plate made from a transparent material in which damage tracks left by fission fragments may be made visible by some process such as etching, irradiating the toned negative with high-energy X-rays, and etching the replication plate to render the damage tracks visible and thereby produce the replica image.

6 Claims, 1 Drawing Figure

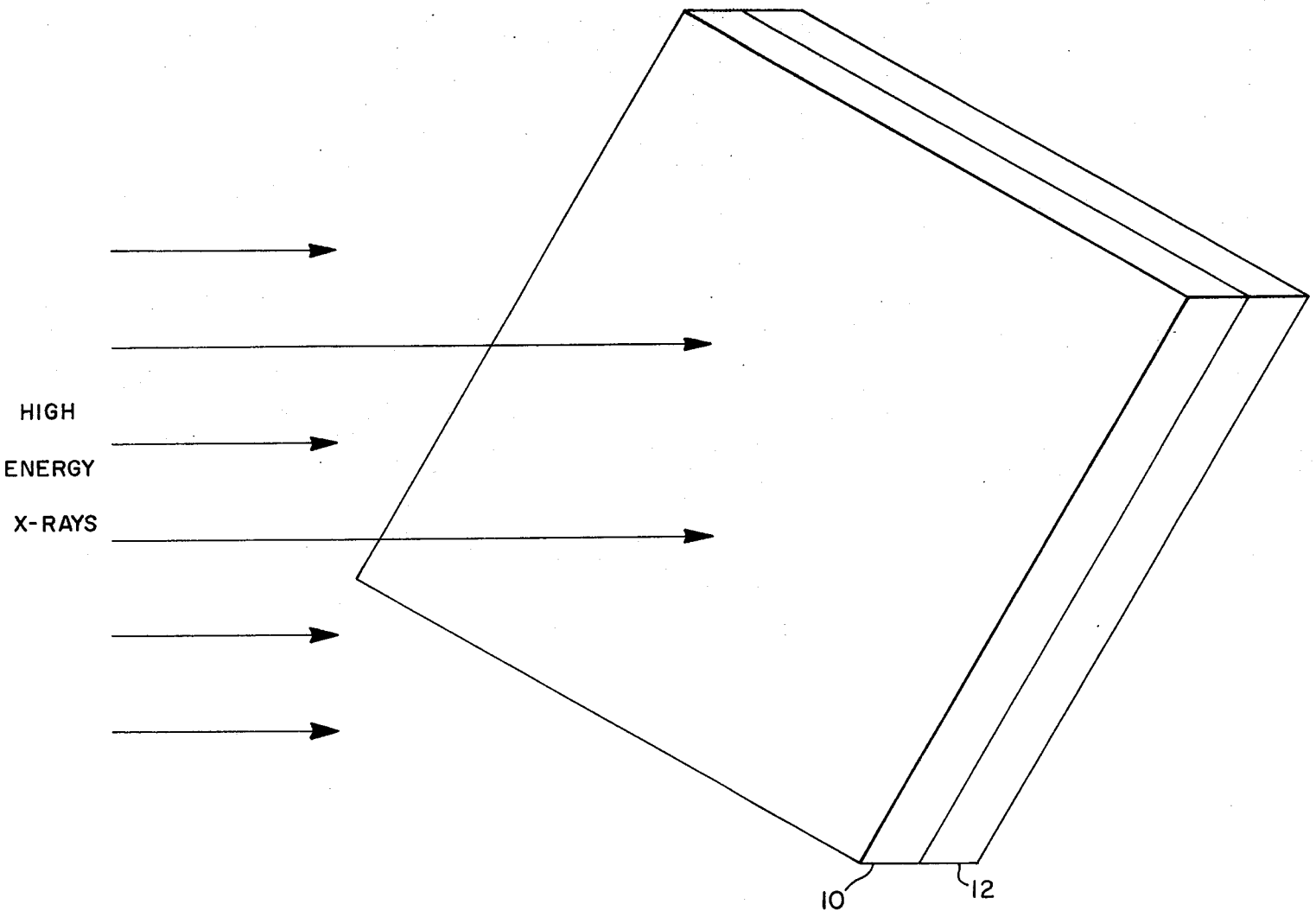
HIGH
ENERGY
X-RAYS
10
12

PHOTOGRAPHIC IMAGE ENHANCEMENT BY PHOTOFISSION

BACKGROUND OF THE INVENTION

This invention relates to a new method for enhancing photographic images and especially to a new method for enhancing photographic images by means of photofission.

Many attempts have been made and methods developed for bringing out faint images which are impressed on photographic film. Recently, experiments have transferred film images to glass and other materials through the mechanism of radiation damage to the glass by fission fragments. The film image has been "toned" with an isotope of californium, $^{252}Cf$, which is a spontaneously fissioning isotope. However, this toning process makes the original film intensely radioactive and very hazardous for a long time. The present invention provides relatively nonhazardous method for obtaining an enhanced image.

SUMMARY OF THE INVENTION

The advantages of the present invention are provided by using, as a toning isotope for the film, an isotope which is low in spontaneous fissionability but can be made to fission by irradiation with high-energy photons.

BRIEF DESCRIPTION OF THE DRAWING

The single FIGURE is a schematic illustration of the invention.

DETAILED DESCRIPTION OF THE INVENTION

A photographic negative 10, i.e., a piece of film which has been exposed to a visual image and which has been developed in the usual manner may have a very faint image because of underexposure or may have portions which are hidden by dark shadow areas. To bring out these faint details, the negative is "toned", i.e., the silver in the emulsion is chemically associated with a "stable" photofissionable isotope. The process of toning is well-known in the photographic art, one type of toning being uranium toning.

Hereinafter, the term "stable photofissioning isotope" will be used to refer to an isotope which is stable i.e., exhibits a low level of spontaneous fission, but can be made to fission by means of irradiation with high-energy photons.

The toned negative 10 is placed in contact with a thin plate 12 of a transparent material, such as glass, in which the damage tracks caused by fissioning fragments of the nucleus of the toning isotope can be made visible by means of etching.

Examples of stable photofisionable isotopes are $^{238}U$, $^{236}Np$, $^{237}Np$, $^{242}Pu$ and $^{244}Pu$; other transuranic isotopes can also be employed.

Examples of materials which can be used for the replication plate 12 are glass, plastics such as cellulose nitrate, and minerals such as mica.

After the toned film negative 10 is placed upon the replica plate 12, the sandwich is exposed to high-energy photons in the form of high-energy X-rays which are caused to strike the film negative side of the sandwich. The X-rays cause the isotope to fission and fission fragments penetrate a short distance, approximately 5 μm, into the glass. The damage tracks form a copy of the original photographic image in the glass. This copy image is made visible by etching the damage tracks for approximately 2–10 minutes with hydrofluoric (HFl) acid.

The image on the glass appears to be frosted and the replica plate can now be used as a negative in an enlarger with a very-well-collimated source of light. It can also be used with any ordinary photographic enlarger by rubbing graphite into the etchings.

The energy of the X-rays should be approximately in the 5–15 MeV range since it is in this range of energies that the photofission reaction takes place. With $^{238}U$ toning, it was found that an exposure time of 7 hours to a source of X-rays with a wide spectrum of energies such as provided by the Naval Research Laboratory linear electron accelerator (LINAC) produced a good replica plate. The plate thickness should be no less than 5 μm since holes are produced if the plate is thinner. If the plate is made of good optical material, there is no upper theoretical limit on the thickness of the plate. Thus, the thickness of the plate becomes just a matter of practicality from the viewpoint of handling problems.

In determining the period of exposure, the following information is used. It is desirable that the number of fission tracks be in the range of 0.1–10 tracks per grain of silver in the film negative. This depends on:

1. The number of fissionable nuclei associated with each silver grain in the negative which, in turn, is related to the size of the grains and the chemistry of the toning process;
2. The area under the curve showing the photofission cross-section versus photon energy for the particular isotope being used for toning the negative;
3. The intensity of X-rays in the energy range of the photofission reaction which can be produced by a particular X-ray generator. (The direction from which the X-rays are projected onto the film negative is not critical as long as they pass through the film negative - for example, the X-rays could pass through the replication plate first.)

As is well-known, the enhancement of contrast in the replica image depends on the amount of etching that is done - the more etching, the greater the enhancement of the contrast of the replica image.

Although toning is a conventional process, one possible toning process is given below. The film negative is bleached for ten minutes in a 3% solution of potassium ferricyanide containing a trace of ammonia. The negative is washed and then toned for ten minutes in a 2.5% uranyl nitrate solution containing 1% acetic acid and 0.5% potassium bromide. (The uranium in the uranyl nitrate consists of more than 90% of the isotope $^{238}U$.) The toned negative is then washed in several changes of 0.1% acetic acid, after which it is dried normally.

Obviously many modifications and variations of the present invention are possible in light of the above teachings. It is therefore to be understood that within the scope of the appended claims the invention may be practiced otherwise than as specifically described.

What is claimed and desired to be secured by Letters Patent of the United States is:

1. A method for producing a plate having a replica image of the photographic image on a developed film negative comprising the steps of:

toning said film negative with a "stable photofissionable isotope";

placing said film negative in contact with a replication plate made from a transparent material in which damage tracks can be made by the products of the fissioning of said isotope and which can be etched to expose said damage tracks to form a replica of the photographic image on said film negative;

irradiating the film negative with high-energy photons while it is in contact with said replication plate so as to cause said isotope to fission and produce damage tracks in said replication plate because of the fission products; and removing the film negative from said replication plate.

2. A method as in claim 1, in which at least some of said high-energy photons have energies lying approximately in the 5–15 MeV range.

3. A method as in claim 1, in which said isotope is $^{238}U$.

4. A method as in claim 1, in which said isotope is selected from the group consisting of $^{236}Np$, $^{237}Np$, $^{242}Pu$ and $^{244}Pu$.

5. A method as in claim 1, in which said replication plate is made from glass.

6. A method as in claim 1, in which said isotope is $^{238}U$, said replication plate is made of glass, and the negative is exposed for a predetermined period of time to high-energy X-rays, the energy band of said photons including the 5–15 MeV range.

* * * * *